US009863183B2

(12) United States Patent
Johnson et al.

(10) Patent No.: US 9,863,183 B2
(45) Date of Patent: Jan. 9, 2018

(54) ANTI-SPUTTERING SILL SYSTEM AND METHOD

(71) Applicant: Andersen Corporation, Bayport, MN (US)

(72) Inventors: Craig Johnson, North Oaks, MN (US); Gerard Lagos, Saint Paul, MN (US); Jared Shanholtzer, Woodbury, MN (US); Alex Sweeney, White Bear Lake, MN (US); Duane Fier, Hudson, WI (US)

(73) Assignee: ANDERSEN CORPORATION, Bayport, MN (US)

( * ) Notice: Subject to any disclaimer, the term of this patent is extended or adjusted under 35 U.S.C. 154(b) by 0 days.

(21) Appl. No.: 14/563,060

(22) Filed: Dec. 8, 2014

(65) Prior Publication Data

US 2015/0159428 A1 Jun. 11, 2015

Related U.S. Application Data

(60) Provisional application No. 61/913,690, filed on Dec. 9, 2013.

(51) Int. Cl.

| | |
|---|---|
| ***E06B 7/14*** | (2006.01) |
| ***E06B 7/02*** | (2006.01) |
| ***E06B 7/10*** | (2006.01) |
| *E06B 1/70* | (2006.01) |
| *E06B 3/46* | (2006.01) |
| *E06B 3/96* | (2006.01) |

(52) U.S. Cl.

CPC ..... *E06B 7/14* (2013.01); *E06B 7/02* (2013.01); *E06B 7/10* (2013.01); *E06B 1/70* (2013.01); *E06B 1/702* (2013.01); *E06B 3/4609* (2013.01); *E06B 3/9632* (2013.01); *E06B 2007/026* (2013.01)

(58) Field of Classification Search

CPC ..... E06B 7/14; E06B 7/10; E06B 7/02; E06B 3/9632; E06B 3/4609; E06B 1/702; E06B 1/70; E06B 2007/026

USPC ..... 7/10, 2; 1/702, 70

See application file for complete search history.

(56) References Cited

U.S. PATENT DOCUMENTS

| | | | | |
|---|---|---|---|---|
| 2,795,018 A | | 6/1957 | Shaw | |
| 3,410,027 A | | 11/1968 | Bates | |
| 3,636,660 A | * | 1/1972 | Peterson | E06B 7/14 49/408 |
| 3,845,599 A | | 11/1974 | Jolly | |
| 5,585,155 A | | 12/1996 | Heikkila et al. | |
| 5,596,151 A | | 1/1997 | Rossini | |
| 5,687,508 A | | 11/1997 | Fitzhenry et al. | |

(Continued)

FOREIGN PATENT DOCUMENTS

| | | | |
|---|---|---|---|
| EP | 0 719 373 | * | 6/1999 |
| EP | 1 726 765 | * | 11/2006 |
| JP | 3011270 | * | 2/2000 |

*Primary Examiner* — Gregory Strimbu

(74) *Attorney, Agent, or Firm* — Mueting, Raasch & Gebhardt, P.A.

(57) ABSTRACT

An anti-sputtering sill system for a window or door frame and a method of controlling sputtering associated with a sill of the window or door frame. The anti-sputtering sill systems may reduce or prevent sputtering by preferentially allowing air bubbles formed in the water in a containment tank in the sill to pass into a vent cavity in the sill that is vented to the interior of a building.

19 Claims, 8 Drawing Sheets

(56) References Cited

U.S. PATENT DOCUMENTS

| | | | | |
|---|---|---|---|---|
| 6,106,944 | A | 8/2000 | Heikkila et al. | |
| 6,210,792 | B1 | 4/2001 | Seethamraju et al. | |
| 6,260,251 | B1 | 7/2001 | Guhl | |
| 6,280,667 | B1 | 8/2001 | Koenig et al. | |
| 6,342,172 | B1 | 1/2002 | Finley | |
| 6,357,186 | B1 * | 3/2002 | Gould | E06B 7/14 52/209 |
| 6,374,557 | B1 | 4/2002 | O'Donnell | |
| 7,600,346 | B2 | 10/2009 | Meeks | |
| 8,033,056 | B2 | 10/2011 | Wernlund et al. | |
| 2002/0112421 | A1 * | 8/2002 | Bennett | E06B 1/6092 52/204.1 |
| 2006/0059780 | A1 * | 3/2006 | Petta | E06B 3/44 49/163 |
| 2009/0199486 | A1 * | 8/2009 | Wernlund | E06B 7/14 49/471 |

* cited by examiner

ANTI-SPUTTERING SILL SYSTEM AND METHOD

CROSS-REFERENCE TO RELATED APPLICATIONS

The present application claims priority under 35 U.S.C. §119 to U.S. Provisional Application Ser. No. 61/913,690 filed on Dec. 9, 2013, which is incorporated herein by reference in its entirety.

An anti-sputtering sill system for windows and doors and methods of controlling sputtering associated with sills in the windows and doors are described herein.

Contain and drain water management systems used in sills can be susceptible to a phenomenon called "spouting" or "sputtering" during high winds coupled with rain. Sputtering occurs when there is water in a containment tank in the sill and the wind pressure reaches a level that forces air up through the water, carrying water droplets with it through the interior opening of the containment tank into the interior of a building in which the window or door is installed.

In those instances where sufficient space is available, sputtering can be contained in the containment tank at some distance away from the interior drain. In some instances, this can be accomplished by, e.g., making the exterior trim of the window or door part of the containment tank. Such an arrangement allows the exterior drain to be placed at a lower position which allows a larger or higher head of water to build up in the containment tank before sputtering occurs. Using the exterior trim as a part of the containment tank can, however, limit the options for exterior trim used in connection with the window or door because the exterior trim must include volumes and/or fluid channels to function as part of the contain and drain water management system.

SUMMARY

An anti-sputtering sill system for windows and doors and methods of controlling sputtering associated with sills in the windows and doors are described herein.

In one or more embodiments, the anti-sputtering sill systems as described herein may reduce or prevent sputtering by preferentially allowing air bubbles formed in the water in a containment tank in the sill to pass into a vent cavity in the sill that is vented to the interior of a building in which the window or door is installed.

In one aspect, one or more embodiments of an anti-sputtering sill system as described herein may include: a window or door frame comprising first and second side jambs connected to each other by a head jamb and a sill, wherein the frame comprises an interior side and an exterior side; a panel retained in the frame, the panel positioned above the sill and between the first and second side jambs; an interior cavity located in the first side jamb, wherein the interior cavity is configured to be vented to the interior side of the frame when the frame is installed in an opening in a building; a trough located in the sill, the trough configured to contain water between the interior side and the exterior side of the sill, wherein the trough is located between the interior side of the sill and the panel; a containment tank located in the sill below the trough; a vent cavity in the sill, the vent cavity in fluid communication with the containment tank through a containment tank vent, wherein at least a portion of the vent cavity is located above the containment tank vent and the containment tank; a first jamb vent located between the vent cavity and the interior cavity in the first side jamb, wherein the vent cavity is in fluid communication with the interior cavity of the first side jamb through the first jamb vent; a trough drain located between the trough and the containment tank, wherein water in the trough drains into the containment tank through the trough drain, and wherein the trough drain comprises a conduit comprising an upper opening and a lower opening, wherein water draining from the trough into the containment tank enters the conduit through the upper opening and leaves the conduit to enter the containment tank through the lower opening, wherein the lower opening is located in the containment tank below the containment tank vent; and an exterior drain in the sill, the exterior drain configured to drain water in the containment tank to an exterior side of the sill.

In one or more embodiments of the anti-sputtering sill systems described herein, the second side jamb comprises an interior cavity located therein, wherein the interior cavity in the second side jamb is configured to be vented to the interior side of the frame when the frame is installed in an opening in a building, and wherein a second jamb vent is located between the vent cavity and the interior cavity in the second side jamb such that the vent cavity is in fluid communication with the interior cavity of the second side jamb through the second jamb vent.

In one or more embodiments of the anti-sputtering sill systems described herein, the conduit of the trough drain is provided in a drain insert located in the trough drain.

In one or more embodiments of the anti-sputtering sill systems described herein, the lower opening of the conduit is located closer to a bottom of the containment tank than the containment tank vent.

In one or more embodiments of the anti-sputtering sill systems described herein, the sill comprises exterior trim attachment features configured to retain exterior trim on the sill, wherein the exterior drain is located above the exterior trim attachment features.

In one or more embodiments of the anti-sputtering sill systems described herein, the panel in the frame comprises a sash in a double-hung or single-hung window.

In one or more embodiments of the anti-sputtering sill systems described herein, the panel in the frame comprises a rotating panel configured to rotate about an axis positioned along the first side jamb, the second side jamb, the head jamb, or the sill.

In one or more embodiments of the anti-sputtering sill systems described herein, the panel in the frame comprises a horizontally sliding panel configured to move horizontally between the first and second side jambs. In one or more embodiments, the horizontally sliding panel comprises a closed position in which the horizontally sliding panel seals against the first side jamb and an open position in which an opening is provided in the frame between the horizontally sliding panel and the first side jamb, and the trough drain is located below the horizontally sliding panel when the horizontally sliding panel is in the closed position. In one or more embodiments, the sill system comprises a plurality of trough drains, and the plurality of trough drains are located below the horizontally sliding panel when the horizontally sliding panel is in the closed position. In one or more embodiments of the sill systems described herein that comprise a containment tank dam located in the containment tank between the first and second side jambs, the containment tank dam is configured to restrict water located in the containment tank between the first side jamb and the containment tank dam from flowing through the containment tank to the second side jamb. In one or more embodiments of the sill systems described herein that comprise a second panel mounted in the frame, the second panel forms a seal with the second side jamb, and further wherein a trough dam is located in the trough at a junction between the horizontally sliding panel and the second panel when the horizontally sliding panel is in the closed position, wherein the trough dam is configured to restrict water located in the trough between the second side jamb and the trough dam from flowing through the trough to the first side jamb. In one or more embodiments, the containment tank dam and the trough dam are aligned with each other between the first and second side jambs.

In another aspect, one or more embodiments of a method of controlling sputtering along a sill of a window or door frame including an anti-sputtering sill system as described herein may include: draining water collected in the trough to the containment tank through a trough drain, wherein water draining from the trough into the containment tank enters an upper opening of a conduit and leaves the conduit to enter the containment tank through a lower opening; draining water from the containment tank to an exterior side of the sill through an exterior drain in the sill; venting fluid from the containment tank into a vent cavity in the sill through a containment tank vent, wherein at least a portion of the vent cavity is located above the containment tank vent and the containment tank, and wherein the containment tank vent is located above the lower opening of the trough drain; and venting fluid from the vent cavity into an interior cavity in the first side jamb through a first jamb vent located between the vent cavity and the interior cavity in the first side jamb.

In one or more embodiments of the methods described herein, the method further comprises venting fluid from the vent cavity into an interior cavity in the second side jamb through a second jamb vent located between the vent cavity and the interior cavity in the second side jamb.

In one or more embodiments of the methods described herein, the lower opening is located closer to a bottom of the containment tank than the containment tank vent.

In one or more embodiments of the methods described herein, the sill includes a containment tank dam located in the containment tank between the first and second side jambs, and wherein the method comprises restricting water located in the containment tank between the first side jamb and the containment tank dam from flowing through the containment tank to the second side jamb.

The above summary is not intended to describe each embodiment or every implementation of the anti-sputtering sill systems and methods described herein. Rather, a more complete understanding of the invention will become apparent and appreciated by reference to the following Description of Illustrative Embodiments and claims in view of the accompanying figures of the drawing.

DESCRIPTION OF ILLUSTRATIVE EMBODIMENTS

Figure 1:
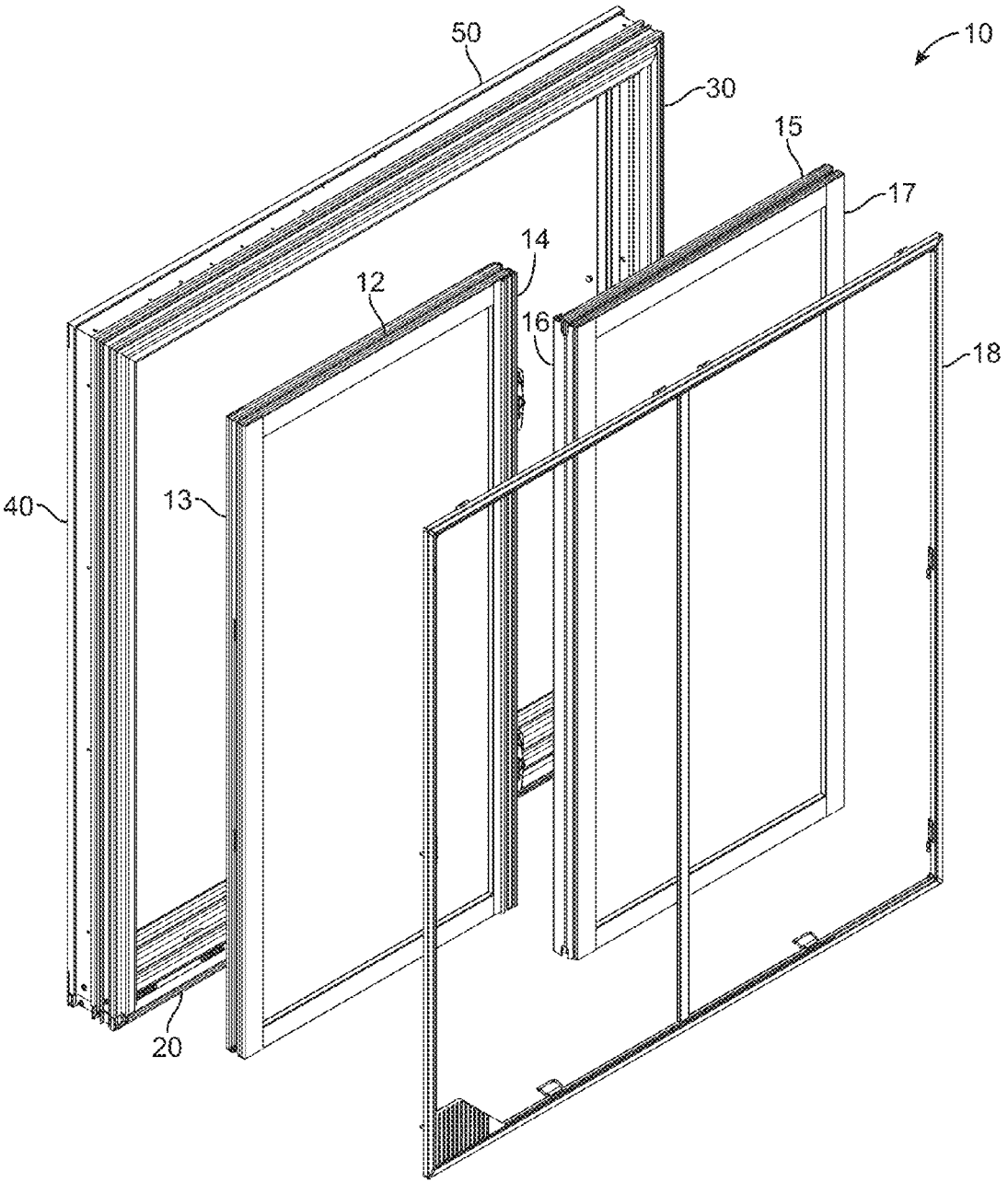
FIG. 1 is an exploded perspective view of one illustrative embodiment of a window including an anti-sputtering sill system as described herein.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

Although the illustrative embodiments described in connection with the figures are focused on anti-sputtering sill systems in windows, the anti-sputtering sill systems described herein may be used in connection with any window or door including a frame having a sill that includes a contain and drain water management system (where it is understood that the sill is the frame component installed at the bottom or lowermost portion of the window or door). The windows may, in one or more embodiments, include one or more panels in the form of one or more fixed sashes and/or one or more moving sashes. The one or more moving sashes may include one or more horizontally sliding sashes, one or more vertically moving sashes (in, e.g., a double hung window, a single hung window, etc.), and/or one or more hinged sashes (in, e.g., a casement window, transom, etc.). The doors may, in one or more embodiments, include one or more fixed panels and/or one or more moving panels, the one or more moving panels may include one or more horizontally sliding panels (in, e.g., a patio door, etc.), one or more vertically moving door panels, and/or one or more hinged door panels. As installed, the windows or doors described herein have a frame that includes an exterior side and an interior side, where the exterior side faces the exterior of a building in which the window or doors installed and the interior side faces the interior of the building.

Various features of the anti-sputtering sill systems described herein are described using terms such as "below" and/or "above" and it should be understood that these terms are used to describe relative positions of the features in a window or door as installed in a building with respect to the direction of gravity.

One illustrative embodiment of a window 10 incorporating an anti-sputtering sill system as described herein is depicted in FIG. 1. As a result, the window 10 will be described as having panels in the form of window sashes. It should, however, be understood that the principles described in connection with the window sashes in the illustrative embodiments would apply equally to any door panel provided in a door incorporating an anti-sputtering sill system as described herein.

The window 10 depicted in FIG. 1 includes a frame having a sill 20 along with a first side jamb 30 and a second side jamb 40. The frame also includes a head jamb 50 and the first and second side jambs 30 and 40 are connected to each other by the sill 20 and head jamb 50. The window 10 also includes a pair of sashes 12 and 15 in the frame. In one or more embodiments, sash 12 may be a moving sash that is configured for movement between the first and second side jambs 30 and 40 along a rail formed in the as described herein, while sash 15 may be fixed in place within the frame. In one or more alternative embodiments, however, both sashes 12 and 15 may move between the first and second side jambs 30 and 40 along rails in the sill 20 to open and close the window 10. In the illustrative embodiment of window 10, an optional screen 18 is also included.

The sash 12 in the illustrative embodiment of window 10 as depicted in FIG. 1 includes edges 13 and 14, while the sash 15 includes edges 16 and 17. In one or more embodiments in which sash 12 is a moving sash and sash 15 is a fixed sash, the moving sash 12 may be moved between the first side jamb 30 and the second side jamb 40 such that edge 13 moves towards or away from the side jamb 40 while edge 14 moves towards or away from the side jamb 30. In an embodiment in which sash 15 is fixed, the edges 16 and 17 of sash 15 typically remain in a fixed location within the frame of the window 10. In one or more embodiments, the sash 12 and sash 15 may include sealing components or structures positioned at or near their respective inner edges 14 and 16 such that the sashes 12 and 15 form a weather tight seal with each other when the movable sash 12 is in its closed position in which edge 13 is located at and forms a seal with the side jamb 40.

In one or more alternative embodiments in which the sash 15 is also a movable sash configured for movement between the first side jamb 30 and the second side jamb 40, the sash 15 may be moved from a closed position in which edge 17 of the sash 15 is located at and forms a seal with the side jamb 30 and open position in which an opening is formed between edge 17 of sash 15 and side jamb 30.

The frame members, i.e., the sill 20, first and second side jambs 30 and 40, and a head jamb 50, described herein may be manufactured by a variety of processes. In one or more embodiments, however, the frame members may be manufactured of an extruded material which may include fibers and a polymer, pultruded materials, metals, etc. Examples of some potentially suitable constructions for frame members that may be used to construct window frames as described herein may include those described in, e.g., U.S. Pat. No. 5,585,155 (Heikkila et al.); U.S. Pat. No. 6,106,944 (Heikkila et al.); U.S. Pat. No. 6,210,792 Seethamraju et al.); U.S. Pat. No. 6,260,251 (Guhl); U.S. Pat. No. 6,280,667 (Koenig et al.); U.S. Pat. No. 6,342,172 (Finley); etc.

Frame members constructed in an extrusion or pultrusion process may include hollows or cavities formed along their length, with the walls and connecting structures of the frame members being formed of the extruded or pultruded material. In one or more embodiments, the hollows or cavities may be filled with one or more materials such as foam, etc. to, e.g., change the insulation characteristics and/or the structural rigidity of the frame members.

Figure 2:
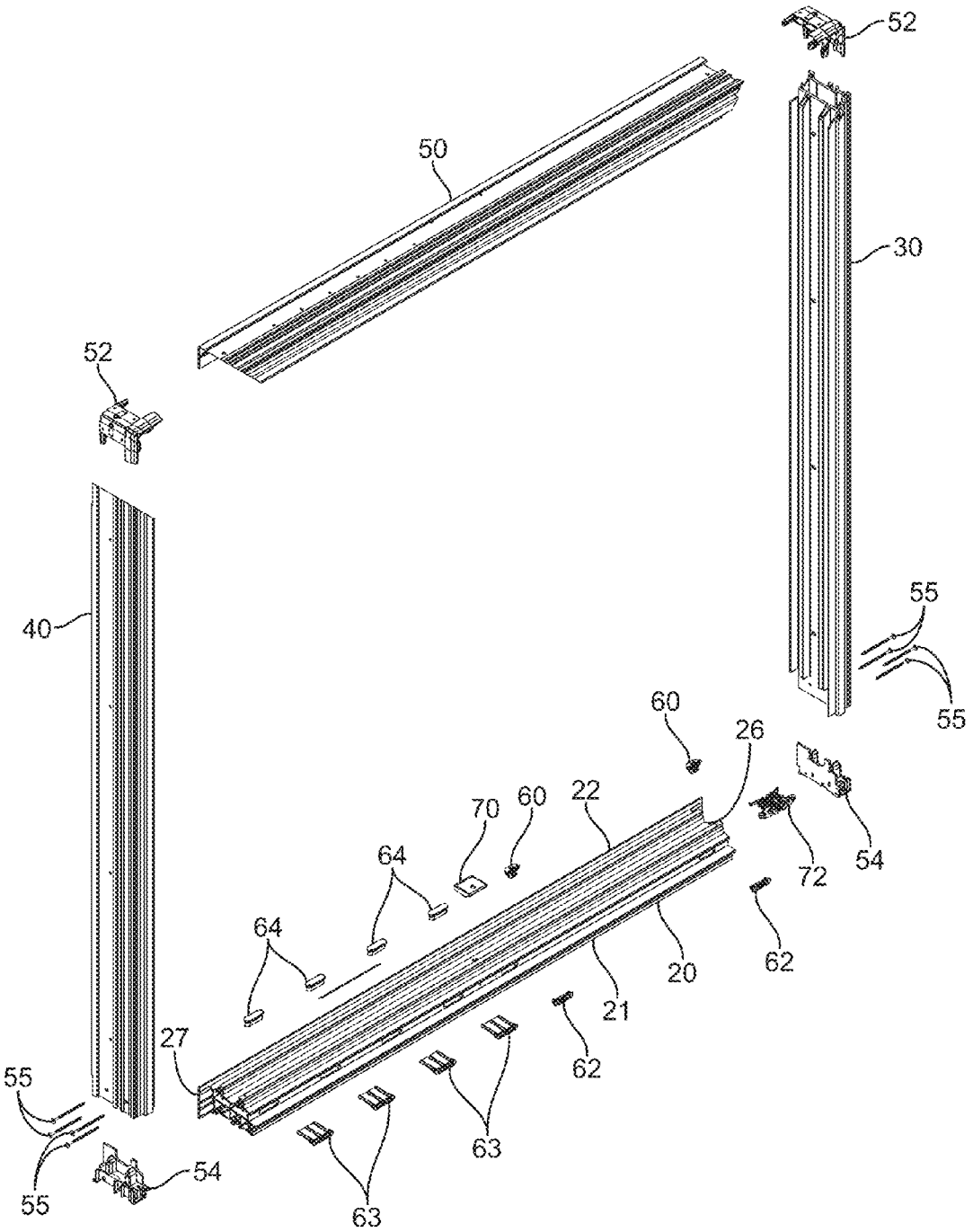
FIG. 2 is an exploded perspective view of the frame of the window depicted in FIG. 1.
Figure 3:
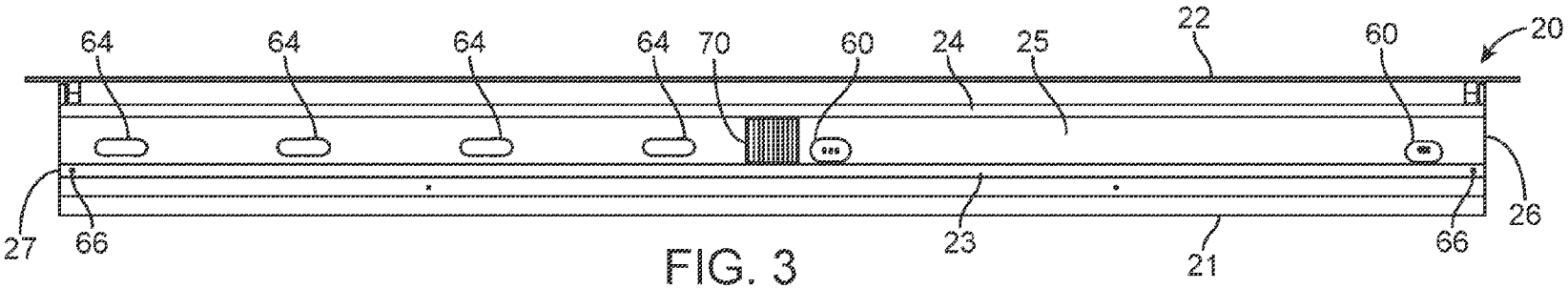
FIG. 3 is a top plan view of one illustrative embodiment of a sill as described herein.

The frame members used to form the frame of the illustrative embodiment of window 10 are depicted in an exploded perspective view in FIG. 2. In particular, the first side jamb 30 is connected to the head jamb 50 using an optional corner key 52 in the depicted illustrative embodiment. Similarly, the second side jamb 40 is also connected to the head jamb 50 using an optional corner key 52. The use of corner keys to connect frame members in windows and doors is known and will not be further described herein. The bottom ends of the first side jamb 30 and the second side jamb 40 include optional end connectors 54 which can be used along with fasteners 55 to attach the bottom ends of the first side jamb 30 and the second side jamb 40 to opposite ends of the sill 20. Although the illustrative embodiment of the frame formed by frame members 20, 30, 40, and 50 includes corner keys and end connectors along with threaded fasteners, in one or more alternative embodiments, the frames may be constructed using any suitable techniques and/or components.

Other components that may be provided in one or more embodiments of the sills used in the anti-sputtering sill systems described herein are also depicted in FIG. 2. In particular, the drain inserts 60 are depicted, along with exterior drains 62, as well as drain covers 64 and their corresponding drain channels 63 are depicted in FIG. 2. Another optional component that is also seen in FIG. 2 is a trough dam 70 that, as described elsewhere herein, limits movement of water within a trough formed in the sill 20. In one or more embodiments, the trough dam 70 may also assist in forming a seal beneath the sashes 12 and 15 in the area occupied by the trough formed in the sill 20. Yet another optional component that is depicted in connection with sill 20 in FIG. 2 is a containment tank dam 72 that, in one or more embodiments, is provided in the sill 20 to restrict water located in a containment tank in the sill 20 from flowing through the containment tank from the first side jamb 30 to the second side jamb 40 as described herein.

More detailed views of the sill 20 and/or second side jamb 40 are depicted in FIGS. 3-8 and construction of the illustrative embodiment depicted in those figures will be described in further detail herein. Although only second side jamb 40 and its associated components are depicted in these figures, it should be understood that the first side jamb 30 and its associated components will, in one or more embodiments, have similar constructions and provide similar functions.

The sill 20 includes an exterior side 21 which is located on an exterior side of the frame and an interior side 22 which is located on an interior side of the frame when the sill 20 is installed in a building. The sill 20 further includes a first end 26 and a second end 27. The first end 26 will typically be attached to a first side jamb (see, e.g., side jamb 30 in FIG. 2) and the second end 27 will typically be attached to a second side jamb (see, e.g., side jamb 40 in FIG. 2).

Also depicted in connection with sill 20 are an exterior rail 23 and an interior rail 24. The exterior rail 23 and interior rail 24 face upward from the sill 20 and are aligned with each other between the first and second ends 26 and 27 of the sill 20 (and, therefore, between the first and second side jambs in a window frame in which sill 20 is located). The exterior rail 23 and interior rail 24 may, in one or more embodiments, form structures on which the sashes in a window using sill 20 are supported and along which the sashes move horizontally (if the sashes are movable sashes). In one or more embodiments, exterior rail 23 may include a top surface 23' (see FIG. 6) that may be used to support a sash on sill 20 (see, e.g., FIG. 10).

A trough 25 is located between the exterior rail 23 and the interior rail 24 of the illustrative embodiment of. The trough 25 is configured to contain water between the exterior rail 23 and the interior rail 24. For the portion of the trough 25 located between a sash that is supported on the exterior rail 23 (see, e.g., sash 15 in FIG. 1), the trough 25 can be described as containing water between the exterior rail 23 and the interior rail 24. In those embodiments in which the sill 20 is used to support a pair of sashes (see, e.g., sashes 12 and 15 in FIG. 1), the trough 25 is located on an interior side of the sash 15 supported on the exterior rail 23, while the trough 25 is located on an exterior side of the sash 12 supported on the interior rail 24.

Although the trough 25 is described as being located between the exterior rail 23 and the interior rail 24 in connection with the illustrative embodiment of sill 20, in one or more alternative embodiments, the sills of anti-sputtering sill systems as described herein may include any walls, barriers, rails, or other structures capable of forming a trough in a sill as described herein. Furthermore, any such structures used to form a trough in a sill as described herein may be at the same height relative to each other (as seen in, e.g., exterior rail 23 and interior rail 24) or they may be at different heights relative to each other.

Figure 6:
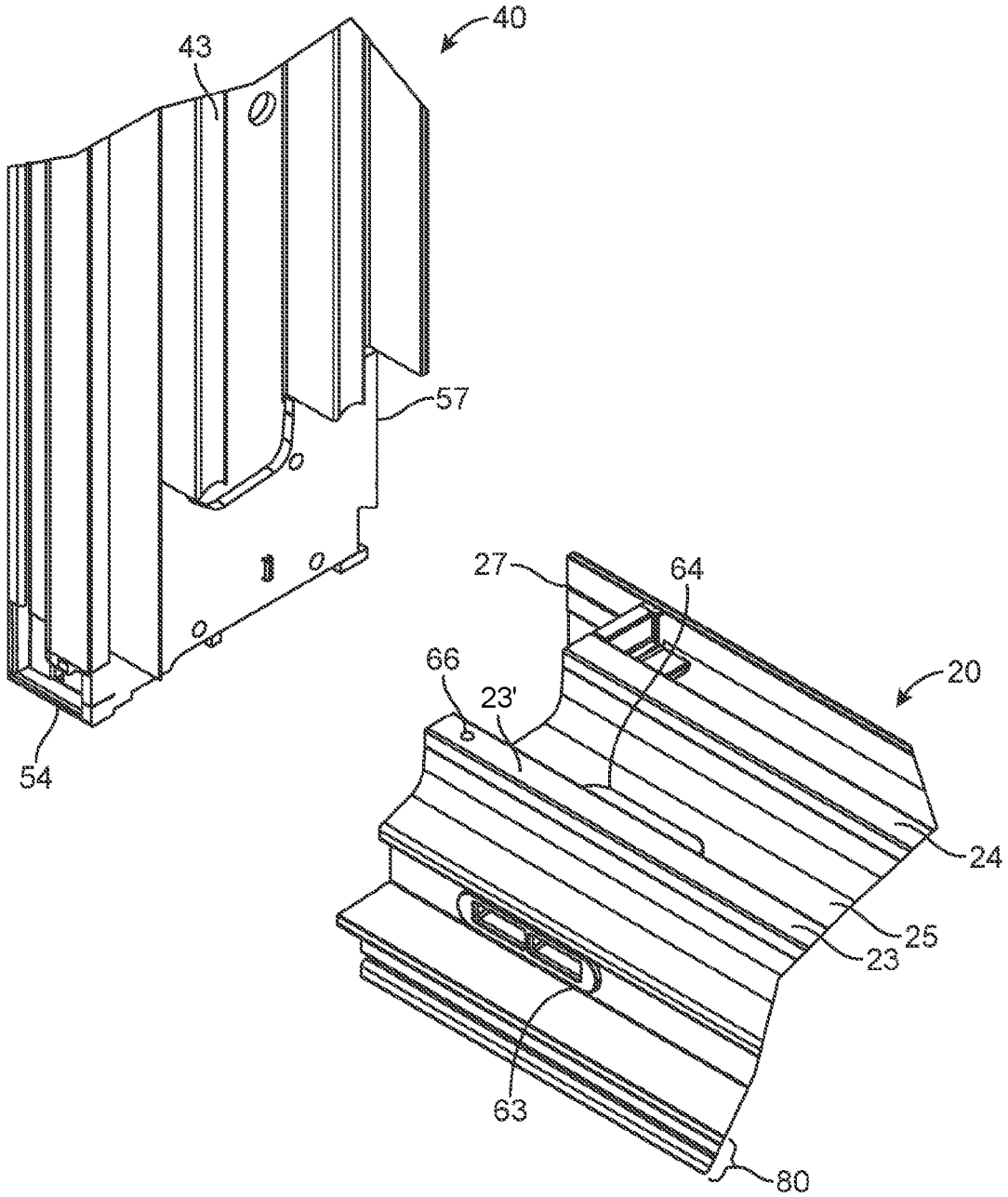
FIG. 6 is a perspective view of the junction between a sill such as that depicted in FIGS. 3-5 and a side jamb in an anti-sputtering sill system as described herein.

The second side jamb 40 is shown as separated from the second end 27 of the sill 20 in FIG. 6. In one or more embodiments, the end connector 54 is attached to the end of the second side jamb 40 and, as depicted, may include a gasket 57. The gasket 57 may be used to seal the cavities located in the sill 20 as described herein against the second side jamb 40. Although not depicted, it will be understood that the first side jamb 30 has a similar construction such that the cavities located in the sill 20 are sealed at both the first end 26 and second end 27 of the sill 20. Although a gasket 57 is used in the illustrated embodiment, other techniques and/or materials such as the use of flowable sealants, adhesives, etc. may also be used to provide the sealing functions offered by the gasket 57.

The sill 20 includes, in one or more embodiments, a first jamb vent 66 located proximate the first end 26 of the sill 20 and a second jamb vent 66 located proximate the second end 27 of the sill 20. The first and second jamb vents 66 are, in one or more embodiments, in fluid communication with a vent cavity 92 that is located in the sill 20 within the exterior rail 23 as depicted in, e.g., the illustrative embodiment of FIG. 8. In one or more embodiments, the jamb vents may be located in a top surface of a rail in sill 20 (see, e.g., jamb vent 66 in top surface 23' of rail 23 in FIG. 6).

As used herein, the term "proximate" as used to describe the position of the jamb vents 66 means that the associated jamb vent 66 is located in a portion of the sill 20 that is capable of placing the vent cavity 92 in the sill 20 in fluid communication with an interior cavity located in the side jamb attached to the respective end of the sill 20. In one or more alternative embodiments, one or more jamb vents may be provided at the ends of the sill or in other suitable locations capable of placing a vent cavity in the sill in fluid communication with an interior cavity as described herein.

One or both of the side jambs used in frames incorporating the anti-sputtering sill systems described herein include an interior cavity that is vented to an interior side of the window frame. In one or more embodiments, the side jambs, such as, e.g., second side jamb 40 used in the anti-sputtering sill systems described herein may include an interior cavity 42 formed in a side rail 43 of the second side jamb 40 as seen in, e.g., FIGS. 6 & 7. The side rail 43 is, in one or more embodiments, aligned with the exterior rail 23 and the sill 20 when the second side jamb 40 is connected to the second end 27 of the sill 20 as a part of the window frame.

Alignment of the side rail 43 with the exterior rail 23 places the interior cavity 42 in the side rail 43 over the second jamb vent 66 such that the vent cavity 92 in the sill 20 is placed in fluid communication with the interior cavity 42 in the second side jamb 40 through the second jamb vent 66. Although not depicted in the figures, an interior cavity may be provided in one or more embodiments of the first side jamb 30 for venting the vent cavity 92 into an interior cavity in the first side jamb 30 through the jamb vent 66 located near the first end 26 of the sill 20.

Figure 7:
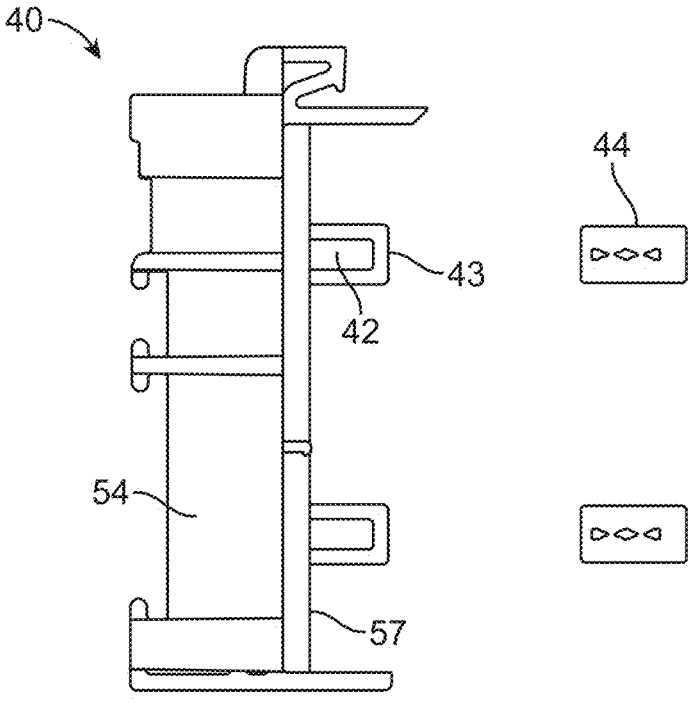
FIG. 7 is bottom end view of the side jamb depicted in FIG. 6.

In one or more embodiments, an optional gasket 44 (depicted as removed from the end of the interior cavity 42 in FIG. 7) may be provided to seal the junction between the side rail 43 and the exterior rail 23 to limit leakage of any fluid passing from the vent cavity 92 in the sill 22 the interior cavity 42 in the side rail 43. Although a gasket is used in the depicted embodiment, any other techniques and/or materials may be used to provide an appropriate seal to this junction.

Although the interior cavity 42 in the second side jamb 40 is depicted as being located in side rail 43, in one or more alternative embodiments, the second side jamb 40 may include an interior cavity in fluid communication with the vent cavity 92 of the sill 20 that is not located in the side rail 43. For example, an interior cavity may be provided in the end connector 54 or in other portions of the second side jamb 40 to provide the appropriate venting function to an interior side of the frame as described herein.

In one or more embodiments, the trough 25 may include a trough dam 70 positioned near the junction of the sashes 12 and 15 when the sashes 12 and 15 are located in the closed position such that their edges 14 and 16 are aligned as described herein. The trough dam 70 is, in one or more embodiments, configured to restrict water located in the trough 25 from moving through the trough. In particular, the trough dam 70 may restrict water located in the trough 25 between the second side jamb 40 and the trough dam 70 from flowing through the trough 25 towards the first side jamb 30.

In one or more embodiments of the anti-sputtering sill systems described herein, the sill 20 includes a containment tank 90 located in the sill 20 below the trough 25 as depicted in, e.g., FIG. 8. In the depicted embodiment, the containment tank 90 can be conveniently formed as a part of the process of forming sill 20 through extrusion or pultrusion as described herein. It should, however, be understood that a containment tank 90 may be provided in other sills constructed using other techniques such as, e.g., drilling, milling, boring, etc., or by fastening structural components together to form a sill that includes a containment tank.

In one or more embodiments, the sill 20 may include an optional containment tank dam 72 which is located in the containment tank 90 between the first end 26 and the second end 27 of the sill 20. The containment tank dam 72 is configured to restrict water located in the containment tank 90 between the first side jamb 30 (attached to the first side 26 of the sill 20) and the containment tank dam 72 from flowing through the containment tank 90 to the second side jamb 40 (which is attached to the second side 27 of the sill 20).

In one or more embodiments in which the sill 20 is formed by extrusion or pultrusion as described herein, the containment tank dam 72 is provided in the form of a separate insert that may be advanced into the containment tank 90 to a location that is essentially below the location of the trough dam 70 in trough 25. In one or more alternative embodiments, the containment tank dam 72 may be formed in the structures that form the containment tank 90 if the sill 20 is not manufactured by extrusion or pultrusion. For example, the containment tank 90 could, in one or more embodiments, be constructed by drilling, milling, boring, etc. the sill 20 from the ends 26 and 27 of the sill 20. Other techniques and structures for forming a containment tank 90 and a sill 20 with a containment tank dam 72 separating the containment tank 90 may also be used to form a containment tank in a sill of an anti-sputtering sill system as described herein.

Figure 4:
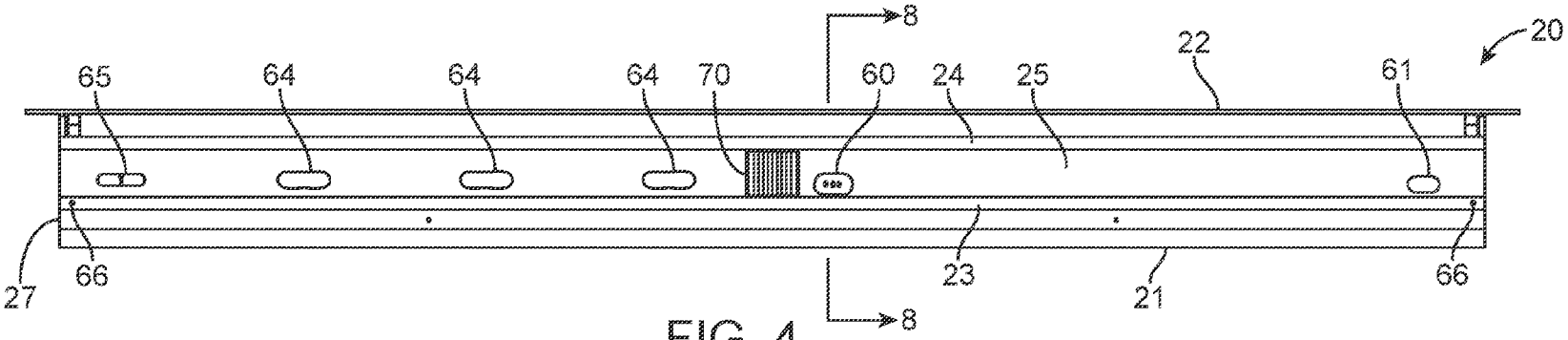
FIG. 4 is a top plan view of the sill depicted in FIG. 3, with drain covers or inserts removed from openings in the sill.
Figure 5:
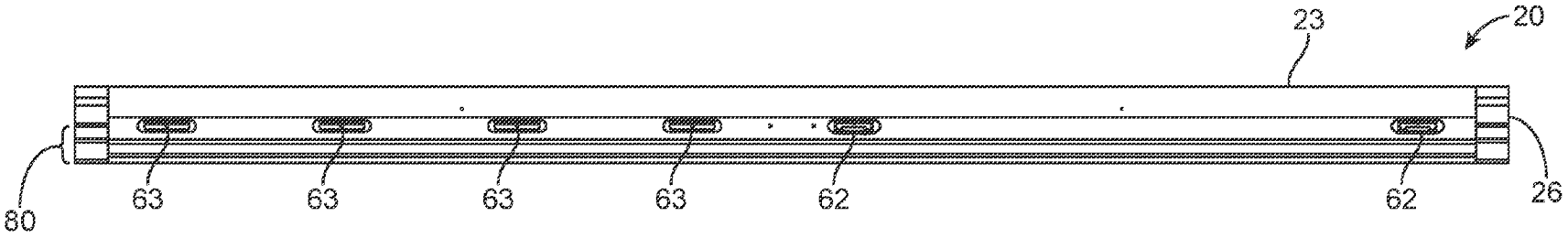
FIG. 5 is a front view of the sill depicted in FIGS. 3 and 4.

Water collected in the trough 25 between the second end 27 of the sill 20 and the trough dam 70 will, in one or more embodiments, be located on an exterior side of a sash supported on interior rail 24. That water will, in one or more embodiments, the drained from the trough 25 through openings 65 (see, e.g., FIG. 4) which, in one or more embodiments, may be covered by drain covers 64 (one of which has been removed from the sill 20 as depicted in FIG. 4). In one or more embodiments, the drain covers 64 may provide a defined fluid path into the drain channels 63 that are inserted into the containment tank 90 in the portion of the sill 20 located between the second side 27 of the sill 20 and the trough dam 70. The drain covers 64 and drain channel 63 are, however, optional and may or may not be required in sills forming a part of the anti-sputtering sill systems described herein.

Water exiting the trough 25 through the drain covers 64 and drain channels 63 that leaks from those defined fluid paths will, in one or more embodiments, be prevented from entering the portion of the containment tank 90 located between the containment tank dam 72 and the first side 27 of the sill 20 by the containment tank dam 72 located in the containment tank 90 as described herein.

Turning now to the portion of the trough 25 located between the first end 26 of the sill 20 and the trough dam 70, the management of water and pressure to provide the anti-sputtering sill systems as described herein will be discussed because it is in this portion of the trough 25 where sputtering would occur on an interior of a building in which the sill 20 is installed.

As depicted in, e.g., FIGS. 4-6 and 8, water collected in the trough 25 between the first end 26 of the sill 20 and the trough dam 70 will drain into the containment tank 90 in the sill 20 through one or more trough drains 61 provided between the trough dam 70 (and an underlying containment tank dam 72 as described herein) and the first end 26 of the sill 20.

In the absence of excessive pressure due to, e.g., wind, water in the containment tank 90 will drain out of the sill 20 on the exterior side 21 of the sill 20 through exterior drains 62. In the depicted embodiment, the exterior drains 62 may include a hinged cover 62*a* that rotates about an upper edge 62*b* (see, e.g., FIG. 8). The hinged covers 62*a* may, in one or more embodiments, limit the intrusion of debris, insects, etc. into the containment tank 90 where those contaminants could, potentially, enter the interior of a dwelling through the trough drain openings 61. The hinged cover 62*a* is, in one or more embodiments, sufficiently light and loosely hinged to allow water in the containment tank 90 to open the cover 62*a* to allow water in the containment tank 90 to drain.

Figure 9:
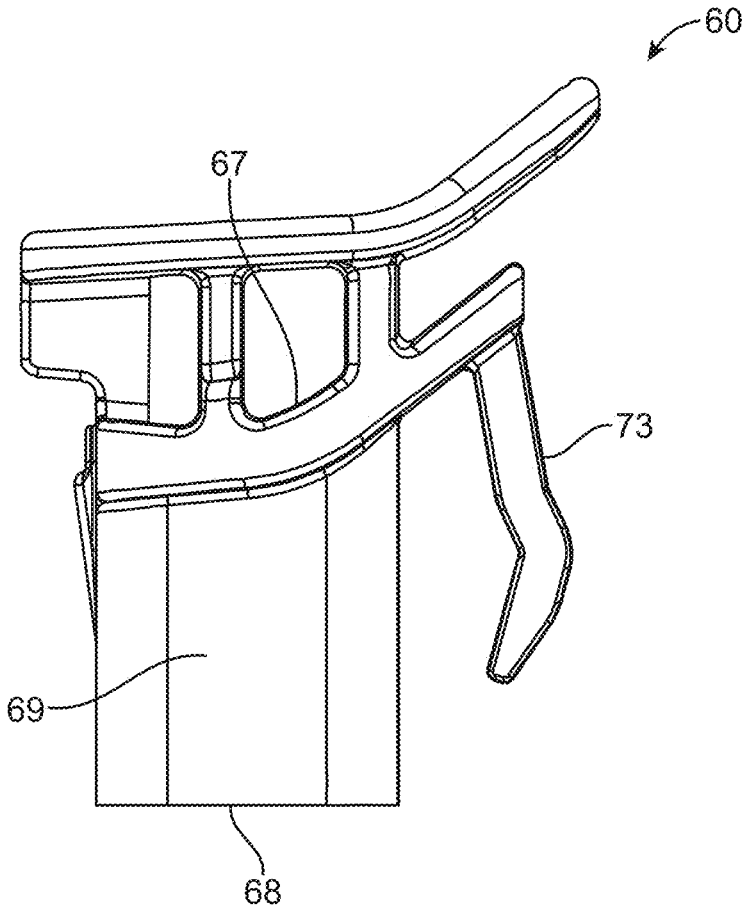
FIG. 9 is a side elevational view of one illustrative embodiment of a drain insert that may be used in connection with the anti-sputtering sill systems as described herein.

In one or more embodiments, each of the trough drains 61 in the trough 25 between the trough dam 70 and the first end 26 of the sill 20 is occupied by a drain insert 60, one illustrative embodiment of which is depicted separately in FIG. 9. The drain insert 60 is sized to fit within the trough drain 61 and includes, in one or more embodiments, a retaining arm 73 that cooperates with the trough drain 61 in the sill 20 to retain the drain insert 60 within a trough drain 61 through an interference fit.

The drain insert 60 may, in one or more embodiments, include a conduit 69 that extends between an upper opening 67 and a lower opening 68. The upper opening 67 is, when the drain insert 60 is located in the trough drain 61 (as depicted in, e.g., FIG. 8). The lower opening 68 is located in the containment tank below the opening 61. Fluid passing into the containment tank through the drain insert 60 enters the upper opening 67 and passes through the conduit 69 to the lower opening 68 before leaving the conduit 69 and entering the containment tank 90.

Figure 8:
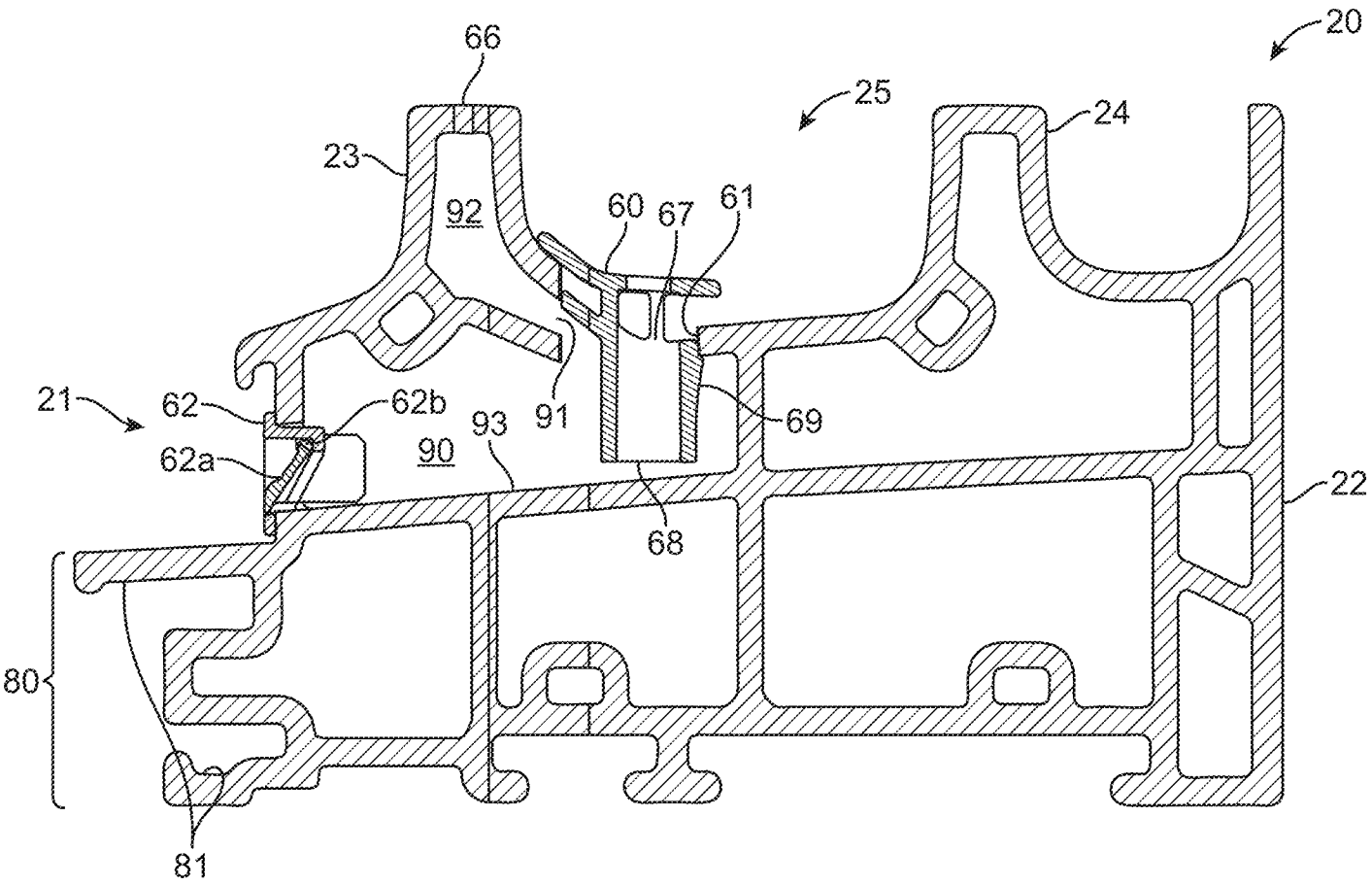
FIG. 8 is a cross-sectional view of the sill depicted in FIGS. 3-6 (taken in a plane transverse to a length of the sill as seen in line 8-8 of FIG. 4) to illustrate fluid management principles of the anti-sputtering sill systems as described herein.

Although the illustrative embodiment of the sill as depicted in, e.g., FIG. 8 includes a conduit having an upper opening and the lower opening using a drain insert 60, in one or more alternative embodiments, the sills in anti-sputtering sill systems as described herein may include features that form conduit having an upper opening and the lower opening as described herein. In particular, where a sill is formed through extrusion or pultrusion, one or more additional walls or barriers may be extruded in the sill to form the upper and lower openings of a conduit as described herein (although the upper and/or lower openings may require additional fabrication through e.g. drilling, milling, boring, etc. in such constructions).

Regardless of how the specific manufacturing techniques used to provide a trough drain in a sill of an anti-sputtering sill system as described herein, water in the trough drains into the containment tank through a trough drain that includes a conduit having an upper opening and a lower opening. More specifically, water draining from the trough into the containment tank enters the conduit through the upper opening and leaves the conduit to enter the containment tank through the lower opening.

Performance of the anti-sputtering sill systems as described herein can, perhaps, best be described with reference to FIGS. 8 and 10. In particular, as depicted in the cross-sectional view of FIG. 8, in which the cross-section of the drain insert 60 is taken with the retaining arm 73 (see, e.g., FIG. 9) removed for clarity. Furthermore, although not typically aligned with a cross-sectional view such as that depicted in FIG. 8, a jamb vent 66 is also included in the cross-sectional views of FIGS. 8 and 10 to assist with a description of fluid flow within the sill 20. It should be understood that the term "fluid" as used to describe functioning of the sills in anti-sputtering sill systems described herein may include liquid water, air, air bubbles, and any combination thereof.

Figure 10:
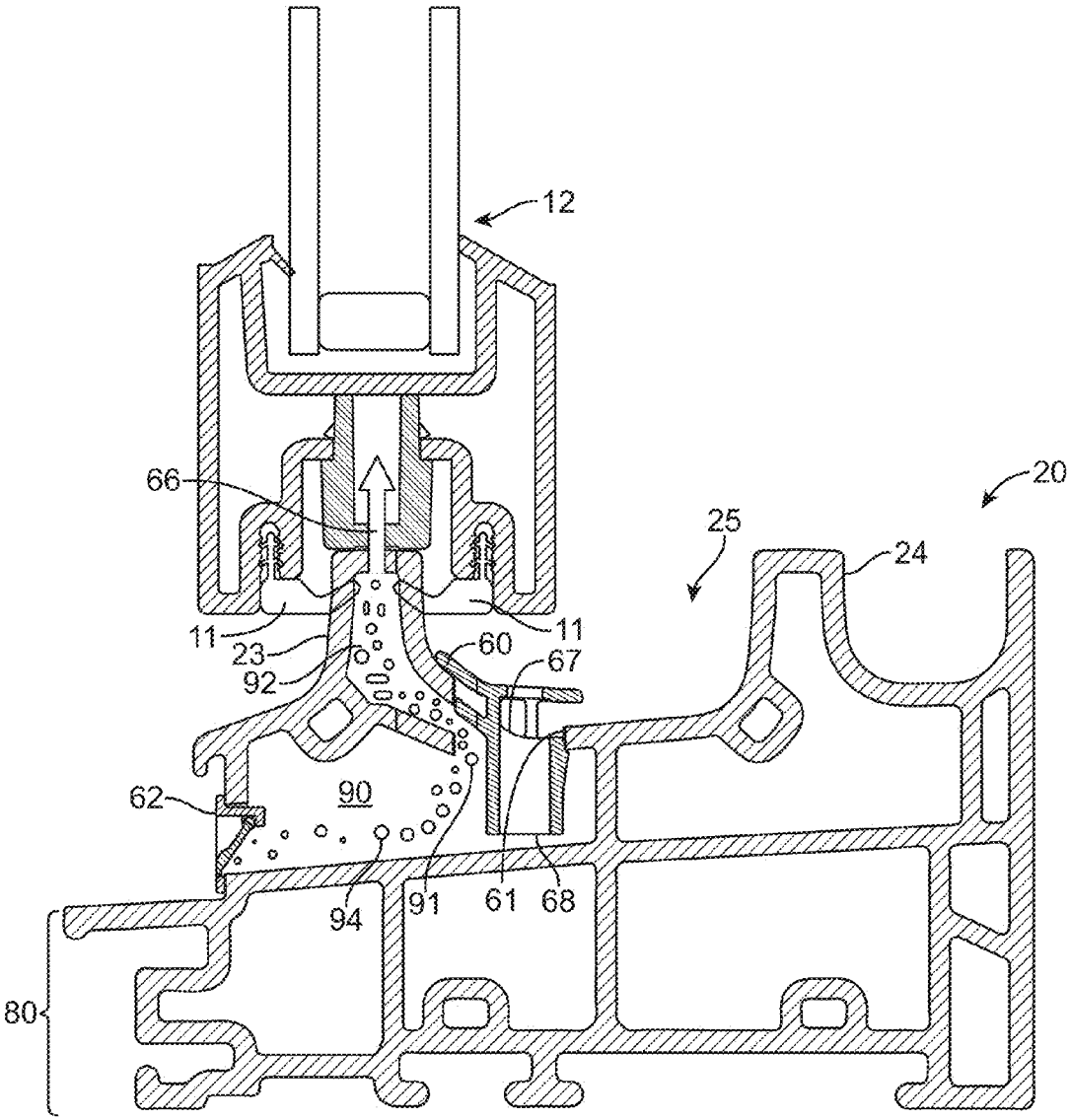
FIG. 10 is a cross-sectional view of a sill as described herein similar to the sill depicted in FIG. 8 illustrating one illustrative embodiment of fluid collection and management in the anti-sputtering sill systems as described herein.

In addition, the cross-sectional view of FIG. 10 also includes a portion of the sash 12 supported on exterior rail 23. The sash 12 may include seals 11 that act on the exterior rail 23 to provide a seal along the lower edge of the sash 12. Under certain environmental conditions, however, those seals 11 may allow water to pass over the exterior rail 23 underneath the sash 12 and that water will collect in the trough 25 as described herein. Because the sash 12 is located on the exterior rail 23, the water located in trough 25 will be located on an interior side of the window.

As discussed herein, the sill 20 includes a containment tank 90 into which water collected in the trough 25 drains through the drain insert 60. The sill 20 further includes a vent cavity 92 that is in fluid communication with containment tank 90 through a containment tank vent 91. In one or more embodiments, at least a portion of the vent cavity 92 is located above the containment tank vent 91 and the containment tank 90. In the depicted embodiment, the containment tank vent 91 is formed, at least partially, by the drain insert 60 although such a construction may or may not be required. In other words, the containment tank vent 91 could be provided separately from the drain insert 60.

In one or more embodiments, the lower opening 68 of the conduit 69 is located below the containment tank vent 91. The lower opening 68 may, in one or more embodiments, be described as being closer to a bottom 93 of the containment tank 90 than the containment tank vent 91.

Positioning the lower opening 68 of the conduit 69 below the containment tank vent 91 may, in one or more embodiments, be advantageous. Referring to, e.g., FIG. 10, in which water is depicted in the trough 25 containment tank 90 and vent cavity 92, excess air pressure exerted on the water in the containment tank 90 through the exterior drain 62 may result in the formation of air bubbles 94 in that water. The containment tank vent 91 may, in one or more embodiments, provide a direct path for those air bubbles 94 formed in the water in the containment tank 90 to exit the containment tank 90 through vent cavity 91 rather than through trough drain 61 (air bubbles 94 passing into the trough 25 would enter the water contained therein and could, potentially cause sputtering on an interior side of the sill 20).

Although not wishing to be bound by theory, providing the containment tank vent 91 above the lower opening 68 preferentially causes air bubbles 94 in the water of containment tank 90 to move into the vent cavity 92 in the sill 20 because of buoyancy of the air bubbles 94. In other words, the air bubbles 94 may resist downward movement through the water in the containment tank 90 to reach the lower opening 68. It should, however, be understood that some portion of the air bubbles 94 in the water in containment tank 90 may enter that lower opening 68 in one or more embodiments of the anti-sputtering sill systems as described herein. The proportion of air bubbles entering the trough 25 will, however, typically be greatly reduced in the anti-sputtering sill systems described herein.

Once in the vent cavity 92, the air bubbles 94 may be vented into an interior cavity that, in one or more embodiments, may be located in one or both of the first and second side jambs through jamb vents 66 as described elsewhere herein. Regardless of their location, the interior cavities into which the vent cavity 92 is vented are themselves vented to the interior side of the frame. Because those interior cavities are vented to an interior side of the frame including the sill 20, the interior cavities will be at a lower air pressure than the air pressure experienced on the exterior side of the frame. That pressure difference provides a path through which fluids in the vent cavity 92 may pass when air pressure on an exterior side of the window frame is higher than air pressure on the interior side.

In one or more embodiments of the anti-sputtering sill systems described herein, the trough drains 61 (and, if provided, the drain inserts 60 located therein) may be aligned with the exterior drain covers 62 between the exterior side 21 and the interior side 22 of the sill 20. In one or more alternative embodiments, however, the trough drains 61 (and optional drain inserts 60) may be offset from each other along the length of the sill 20 (as measured between the first end 26 and the second end 27) to provide an even longer flow path for air bubbles formed in water collected in containment tank 90 to reach the lower openings 68 of the trough drains as described herein.

Further, the trough drains may, in one or more embodiments, include a lower opening that is oriented or shaped in a manner that further inhibits entry of air bubbles in water in the containment tank into the lower opening (where it could pass into the trough formed in the sill).

In one or more embodiments of the sills used in anti-sputtering sill systems described herein, the sill 20 may include exterior trim attachment features 80 (see, e.g., the cross-sectional view of sill 20 in FIG. 8) that are configured to retain exterior trim on the sill 20. The exterior drains 62 provided to allow water to exit the containment tank 90 are, in one or more embodiments, located above the exterior trim attachment features 80. The exterior trim attachment features 80 may take a variety of different forms, only one of which is depicted in connection with the illustrative embodiments described herein. In particular, the exterior trim attachment features 80 may include retaining arms 81 that are configured to mate with features on exterior trim to be attached to the sill 20 as a part of installation of a window including sill 20.

The complete disclosure of any patents, patent documents, and publications identified herein are incorporated by reference in their entirety as if each were individually incorporated.

Illustrative embodiments of the anti-sputtering sill systems and methods of draining water from sills are discussed and reference has been made to possible variations. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. An anti-sputtering sill system comprising:

a closure frame comprising first and second side jambs connected to each other by a head jamb and a sill, wherein each of the first and second side jambs and the sill comprise an interior side and an exterior side, and wherein the sill comprises a rail extending between the first and second side jambs;

a panel retained in the frame, the panel positioned above and supported by the rail, wherein the panel is retained between the first and second side jambs;

an interior cavity located in the first side jamb;

a trough located in the sill, the trough configured to contain water between the interior side and the exterior side of the sill, wherein the trough is located between the interior side of the sill and the rail supporting the panel;

a containment tank located in the sill below the trough;

a vent cavity in the sill, the vent cavity in fluid communication with the containment tank through a containment tank vent, wherein at least a portion of the vent cavity is located above the containment tank vent and the containment tank;

a first jamb vent located in a top surface of the rail, the first jamb vent being located between the vent cavity and the interior cavity in the first side jamb, wherein the vent cavity is in fluid communication with the interior cavity of the first side jamb through the first jamb vent, and wherein the first jamb vent is located above the containment tank vent such that fluid passing into the interior cavity in the first side jamb from the containment tank must pass through the containment tank vent and the vent cavity before passing through the first jamb vent into the interior cavity in the first side jamb;

a trough drain located between the trough and the containment tank, wherein the water in the trough drains into the containment tank through the trough drain, and wherein the trough drain comprises a conduit comprising an upper opening and a lower opening, wherein the water draining from the trough into the containment tank enters the conduit through the upper opening and leaves the conduit to enter the containment tank through the lower opening, wherein the lower opening is located in the containment tank below the containment tank vent; and an exterior drain in the sill, the exterior drain configured to drain water in the containment tank to the exterior side of the sill.

2. A sill system according to claim 1, wherein the second side jamb comprises an interior cavity located therein, wherein a second jamb vent is located between the vent cavity and the interior cavity in the second side jamb such that the vent cavity is in fluid communication with the interior cavity of the second side jamb through the second jamb vent.

3. A sill system according to claim 1, wherein the conduit is a drain insert.

4. A sill system according to claim 1, wherein the lower opening is located closer to a bottom of the containment tank than the containment tank vent.

5. A sill system according to claim 1, wherein the sill comprises exterior trim attachment features configured to retain exterior trim on the sill, wherein the exterior drain is located above the exterior trim attachment features.

6. A sill system according to claim 1, wherein the panel comprises a horizontally sliding panel configured to move horizontally between the first and second side jamb s.

7. A sill system according to claim 6, wherein the horizontally sliding panel is configured to move between a closed position in which the horizontally sliding panel seals against the first side jamb and an open position in which an opening is provided in the frame between the horizontally sliding panel and the first side jamb, and wherein the trough drain is located below the horizontally sliding panel when the horizontally sliding panel is in the closed position.

8. A sill system according to claim 7, wherein the sill system comprises a plurality of trough drains, and wherein the plurality of trough drains are located below the horizontally sliding panel when the horizontally sliding panel is in the closed position.

9. A sill system according to claim 7, further comprising a containment tank dam located in the containment tank between the first and second side jambs, wherein the containment tank dam is configured to restrict the water located in the containment tank between the first side jamb and the containment tank dam from flowing through the containment tank to the second side jamb.

10. A sill system according to claim 7, further comprising a second panel mounted in the frame, wherein the second panel forms a seal with the second side jamb, and further wherein a trough dam is located in the trough below a junction between the horizontally sliding panel and the second panel when the horizontally sliding panel is in the closed position, wherein the trough dam is configured to restrict the water located in the trough between the second side jamb and the trough dam from flowing through the trough to the first side jamb.

11. A sill system according to claim 10 that, further comprising a containment tank dam located in the containment tank between the first and second side jambs, wherein the containment tank dam is configured to restrict the water located in the containment tank between the first side jamb and the containment tank dam from flowing through the containment tank to the second side jamb, wherein the containment tank dam and the trough dam are aligned with each other between the first and second side jambs.

12. An anti-sputtering sill system comprising:

a closure frame comprising first and second side jambs connected to each other by a head jamb and a sill, wherein each of the, first and second side jambs, and the sill comprise an interior side and an exterior side, and wherein the sill comprises a rail extending between the first and second side jambs;

a first panel retained in the frame, the first panel positioned above and supported by the rail, wherein the first panel is retained between the first and second side jambs, wherein the first panel comprises a horizontally sliding panel configured to move horizontally between the first and second side jambs, and wherein the first panel is configured to move between a closed position in which the first panel seals against the first side jamb and an open position in which an opening is provided in the frame between the first panel and the first side jamb;

a second panel mounted in the frame, the second panel positioned above the sill and between the first and second side jambs, wherein the second panel forms a seal with the second side jamb;

an interior cavity located in the first side jamb; wherein the interior cavity is configured a trough located in the sill, the trough configured to contain water between the interior side and the exterior side of the sill;

a containment tank located in the sill below the trough;

a containment tank dam located in the containment tank between the first and second side jambs, wherein the containment tank dam is configured to restrict water located in the containment tank between the first side jamb and the containment tank dam from flowing through the containment tank to the second side jamb;

a vent cavity in the sill, the vent cavity in fluid communication with the containment tank through a containment tank vent, wherein at least a portion of the vent cavity is located above the containment tank vent and the containment tank;

a first jamb vent located in a top surface of the rail, the first jamb vent being located between the vent cavity and the interior cavity in the first side jamb, wherein the vent cavity is in fluid communication with the interior cavity of the first side jamb through the first jamb vent, and wherein the first jamb vent is located above the containment tank vent such that fluid passing into the interior cavity in the first side jamb from the containment tank must pass through the containment tank vent and the vent cavity before passing through the first jamb vent into the interior cavity in the first side jamb;

a trough drain located between the trough and the containment tank, wherein the trough drain is located below the first panel when the first panel is in the closed position, wherein the water in the trough drains into the containment tank through the trough drain, and wherein the trough drain comprises a conduit comprising an upper opening and a lower opening, wherein the water draining from the trough into the containment tank enters the conduit through the upper opening and leaves the conduit to enter the containment tank through the lower opening, wherein the lower opening is located in the containment tank below the containment tank vent;

an exterior drain in the sill, the exterior drain configured to drain the water in the containment tank to the exterior side of the sill; and a trough dam is located in the trough below a junction between the first panel and the second panel when the first panel is in the closed position, wherein the trough dam is configured to restrict the water located in the trough between the second side jamb and the trough dam from flowing through the trough to the first side jamb.

13. A sill system according to claim 12, wherein the second side jamb comprises an interior cavity located therein, wherein a second jamb vent is located between the vent cavity and the interior cavity in the second side jamb such that the vent cavity is in fluid communication with the interior cavity of the second side jamb through the second jamb vent.

14. A sill system according to claim 12, wherein the lower opening is located closer to a bottom of the containment tank than the containment tank vent.

15. A sill system according to claim 12, wherein the sill system comprises a plurality of trough drains, and wherein the plurality of trough drains are located below the first panel when the first panel is in the closed position.

16. A method of controlling sputtering using the anti-sputtering sill system according to claim 1, wherein the method comprises:

draining the water in the trough to the containment tank through the trough drain;

draining the water from the containment tank to the exterior side of the sill through the exterior drain in the sill;

venting the fluid from the containment tank into the vent cavity in the sill through the containment tank vent; and venting the fluid from the vent cavity into the interior cavity in the first side jamb through the first jamb vent.

17. A method according to claim 16, wherein the method further comprises venting the fluid from the vent cavity into an interior cavity in the second side jamb through a second jamb vent located between the vent cavity and the interior cavity in the second side jamb.

18. A method according to claim 16, wherein the lower opening is located closer to a bottom of the containment tank than the containment tank vent.

19. A method according to claim 16, wherein the sill includes a containment tank dam located in the containment tank between the first and second side jambs, and wherein the method comprises restricting the water located in the containment tank between the first side jamb and the containment tank dam from flowing through the containment tank to the second side jamb.

* * * * *